US010982693B2

(12) United States Patent
Faivre et al.

(10) Patent No.: US 10,982,693 B2
(45) Date of Patent: Apr. 20, 2021

(54) AUTOMATICALLY ACTUATED SHUNT VALVE SYSTEM

(71) Applicant: Deere & Company, Moline, IL (US)

(72) Inventors: Damien Faivre, Apremont (FR); Hugues Bertrand, Rioz (FR); Lionel Guiet, Gray (FR)

(73) Assignee: DEERE & COMPANY, Moline, IL (US)

( * ) Notice: Subject to any disclaimer, the term of this patent is extended or adjusted under 35 U.S.C. 154(b) by 170 days.

(21) Appl. No.: 15/949,891

(22) Filed: Apr. 10, 2018

(65) Prior Publication Data

US 2019/0309772 A1 Oct. 10, 2019

(51) Int. Cl.

| | |
|---|---|
| ***F15B 13/08*** | (2006.01) |
| ***F15B 13/02*** | (2006.01) |
| *F15B 13/04* | (2006.01) |
| *E02F 3/36* | (2006.01) |

(52) U.S. Cl.

CPC ..... *F15B 13/0807* (2013.01); *F15B 13/021* (2013.01); *E02F 3/3654* (2013.01); *F15B 13/0405* (2013.01); *F15B 13/0406* (2013.01); *F15B 2211/3058* (2013.01)

(58) Field of Classification Search

CPC ..... F15B 2211/3058; F15B 13/0406; F15B 13/0405; F15B 13/021; F15B 13/0807; E02F 3/3654

See application file for complete search history.

(56) References Cited

U.S. PATENT DOCUMENTS

| | | | |
|---|---|---|---|
| 9,226,439 | B2 | 1/2016 | Faivre et al. |
| 2015/0020892 | A1 | 1/2015 | Behr et al. |
| 2017/0202128 | A1 | 7/2017 | Emmert et al. |

FOREIGN PATENT DOCUMENTS

| | | | |
|---|---|---|---|
| CA | 1148988 | A | 6/1983 |
| DE | 202006019277 | U1 | 3/2007 |

OTHER PUBLICATIONS

European Search Report issued in counterpart application No. 19160838.9, dated Sep. 16, 2019, 7 pages.

*Primary Examiner* — Michael R Reid
(74) *Attorney, Agent, or Firm* — Tucker Ellis LLP; Michael G. Craig; Heather M. Barnes

(57) ABSTRACT

An automatically actuated shunt valve system opens and closes a passage between two chambers of a powered element operated by a power source. The shunt valve system includes a coupler connecting the powered element with the power source through two mating coupling elements. One of the coupling elements includes a valve contact and the other includes a shunt valve assembly. The shunt valve assembly includes a valve chamber connected with both chambers of the powered element, a valve element opening or closing a flow path between the conduits, and a shaft for moving the valve element. The shaft engages the valve contact to move the valve element to close the flow path when the coupling elements are mated together, and moves the valve element to open the flow path when the shaft disengages from the valve contact as the coupling elements are disconnected from one another.

12 Claims, 13 Drawing Sheets

AUTOMATICALLY ACTUATED SHUNT VALVE SYSTEM

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to detachable equipment for work vehicles and more particularly, to automatically actuated shunt valves usable with a detachable front loader.

BACKGROUND OF THE DISCLOSURE

Work vehicles, such as those used in the agriculture, construction and forestry industries, and other vehicles, equipment and machinery may include connectors for releasably coupling power lines between the work vehicle and an implement or other equipment. The power lines may communicate hydraulic or other fluids, electric current, mechanical motion, or other forms of transmissions. One such application involves loaders such as those mounted on an agricultural tractor. When the loader is not needed, it can be removed from the tractor and parked. During parking, the power lines between the tractor and loader need to be decoupled. The connections typically require manual coupling and decoupling, often involving multiple steps. These steps may involve climbing off and reboarding the tractor, moving around to access various mechanisms, and operating various mechanisms. Accordingly, simplifying the connection process would be beneficial.

SUMMARY OF THE DISCLOSURE

According to one aspect of the disclosure, a shunt valve system alternatively opens and closes a passage between two chambers of a powered element that is operated by a power source. The shunt valve system includes a coupler connecting the powered element with the power source through two mating coupling elements. One of the coupling elements includes a valve contact and the other includes a shunt valve assembly. The shunt valve assembly includes a valve chamber, a conduit connecting the valve chamber with one chamber of the powered element, another conduit connecting the valve chamber with the other chamber of the powered element, a valve element alternatively opening or closing a flow path between the conduits, and a shaft for moving the valve element. The shaft engages the valve contact to move the valve element to close the flow path when the coupling elements are mated together, and moves the valve element to open the flow path when the shaft disengages from the valve contact as the coupling elements are disconnected from one another.

In other aspects, a shunt valve system includes a cylinder that has a piston separating the cylinder into a barrel chamber and a rod chamber. A rod extends from the piston through the rod chamber. A coupler connects the cylinder with a power source and includes a pair of coupling elements, one connected with the barrel and piston chambers and another that includes a valve contact. The coupling elements mate with one another to connect the cylinder with the power source, and when uncoupled, simultaneously open a flow path between the barrel chamber and the rod chamber. A shunt valve assembly is contained in one coupling element and includes a valve chamber connected with the barrel and rod chambers by conduits. A valve element alternatively opens or closes the flow path. A shaft moves the valve element and extends from one of the coupling elements. The shaft effects movement of the valve element to close the flow path when the shaft engages the valve contact as the coupling elements are mated together, and to open the flow path when the shaft disengages from the valve contact as the coupling elements are disconnected from one another.

In additional aspects, a shunt valve system for a front loader includes a cylinder providing lift for the front loader. The cylinder has a piston separating the cylinder into a barrel chamber and a rod chamber. A rod extends from the piston and through the rod chamber. A coupler connects the cylinder with a power source and includes one coupling element connected with the barrel and piston chambers, and another coupling element that includes a valve contact. The coupling elements mate with one another to connect the cylinder with the power source and disconnect from one another and open a flow path between the barrel chamber and the rod chamber simultaneous with disconnecting. A shunt valve assembly is contained in one of the coupling elements and includes a valve chamber connected with the barrel and rod chambers through conduits. A valve element alternatively opens or closes the flow path by a shaft that moves the valve element. One spring contacts the shaft and another spring contacts the valve element. The shaft and one spring effect movement of the valve element to close the flow path when the shaft engages the valve contact as the coupling elements are mated together. The shaft and the other spring effect movement of the valve element to open the flow path when the shaft disengages from the valve contact as the coupling elements are disconnected from one another.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
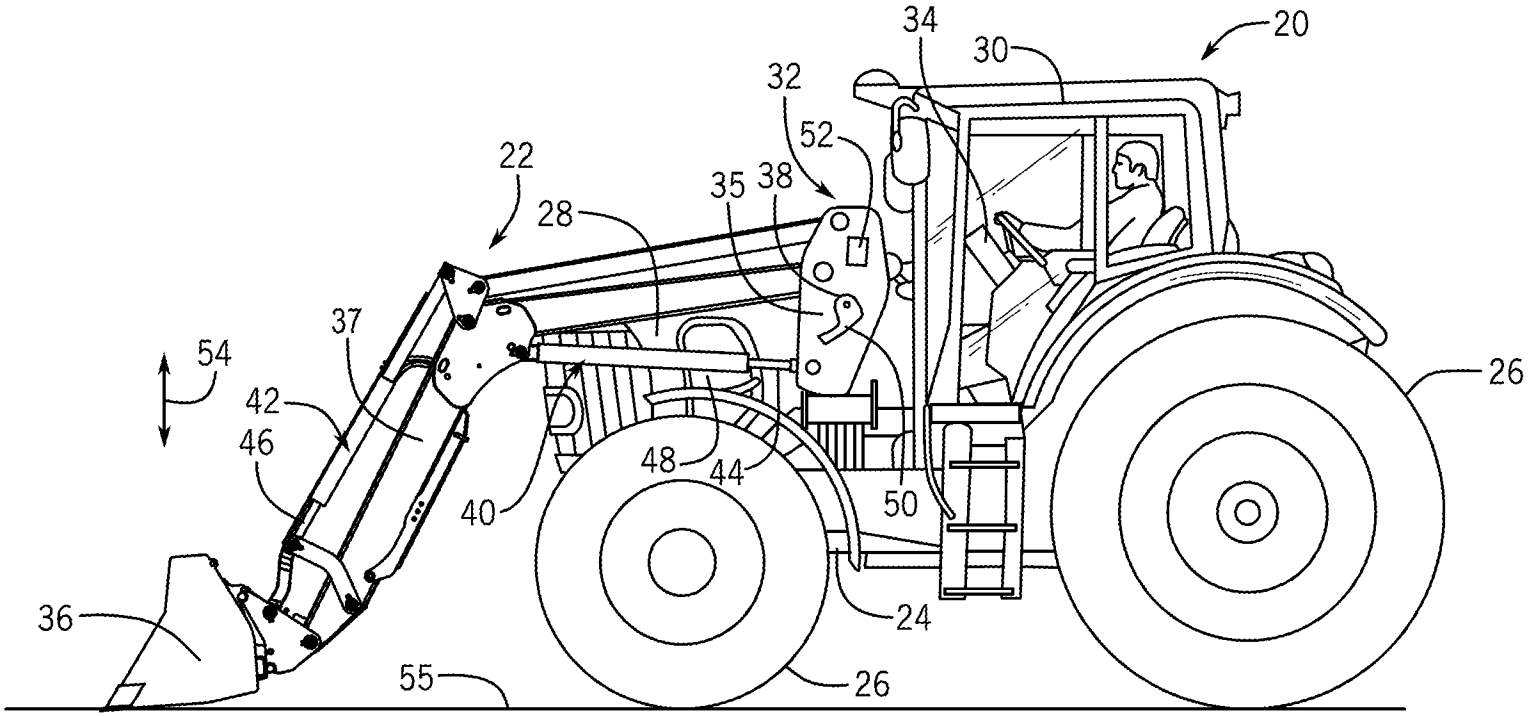
FIG. 1 is a side view of an example work vehicle in the form of an agricultural tractor with a front loader in which the disclosed automatically actuated shunt valve system may be used.

The following describes one or more example embodiments of the disclosed automatically actuated shunt valve system as shown in the accompanying figures of the drawings described briefly above. Various modifications to the example embodiments may be contemplated by one of skill in the art.

As noted above, removing a front loader from a work vehicle can be complex. In an example embodiment, removing a front loader involves mechanically unhitching the loader and decoupling the power lines by disconnecting a multi-coupler. The multi-coupler connects and disconnects a number of lines and simultaneously actuates a shunt valve. When the multi-coupler is uncoupled the shunt valve opens a passage, un-trapping hydraulic fluid and allowing the front loader's lift cylinder piston to move in its cylinder. Allowing the cylinder piston to move allows the hitch area of the front loader to move up and down relative to the work vehicle, so that the work vehicle may be readily driven in reverse to separate from the loader, and in forward to reconnect with the loader. In addition, the shunt valve operates so that the power lines may be readily disconnected under hydraulic pressure in the cylinders. As a result, a more efficient and effective coupling and decoupling of equipment such as a loader is achieved.

In one or more example implementations of the disclosed system, a multi-coupler includes mating coupling elements. A shunt valve assembly is contained in one of the coupling elements. A valve chamber is connected with a powered element, such as a lift cylinder. A valve element is disposed in the valve chamber and alternatively opens or closes a flow path between the two sides of the lift cylinder's piston. A shaft moves the valve element to open the flow path when the coupling elements are disconnected from one another, and moves the valve element to close the flow path when the coupling elements are mated together. Opening the flow path equalizes pressure on the two sides of the lift cylinder piston and allows the piston to move in its cylinder, facilitating unhitching and hitching of the loader from/to the work vehicle.

Example environments in which a shunt valve system may be implemented include work vehicles, other vehicles, and machines that use a coupling system that when disconnected, provides an open flow path between two elements. Example work vehicles include a tractor, loader, backhoe, excavator, harvester, truck, dozer, skid steer, and other vehicles for off-road uses, including those used in the construction, agriculture, or forestry industries. Other vehicles include passenger vehicles, other on-road vehicles, recreation vehicles, tow-vehicles, and load carrying vehicles. Other machinery and equipment types include those that have fluid powered features.

The following description relates to systems in the context of certain work vehicle applications for purposes of demonstrating examples. In these applications, efficient and effective coupling and decoupling is desired. The present disclosure is not limited to any particular vehicle applications, or to any particular type of implement, but rather also encompasses any application where decoupling results in the opening of a flow passage. Accordingly, the teachings of the present disclosure may be applied to shunt valve systems in a variety of applications, including with work vehicle front loaders, when desired.

As noted above, the disclosed shunt valve system described herein may be employed in a variety of applications. Referring to FIG. 1, one example involves a work vehicle 20, which in this example is depicted as an agricultural tractor equipped with a front loader 22. It will be understood, however, that other configurations are contemplated, including configurations with the work vehicle 20 as a different kind of tractor, or as a work vehicle used for other aspects of the agriculture industry or for the construction or forestry industries (e.g., a harvester, a log skidder, motor grader, and so on). It will further be understood that the disclosed shunt valve system may also be used in non-work vehicles, non-vehicle applications (e.g. stationary installations), and with other types of equipment and machines where a shunt valve system for opening a flow path upon decoupling is useful. In the current example, the work vehicle 20 has a frame or chassis 24 supported by wheels 26 that engage the ground. Two or four of the wheels 26 may be powered for propelling the work vehicle 20, and the front wheels 26 may be steerable to control the direction of travel. The chassis 24 supports a power plant in the form of an internal combustion engine, in this example, referred to as an engine 28. A powertrain transmission (not shown), connects the engine 28 with the wheels 26 to provide different speed ratios for varying operating conditions. An operator cabin 30 is provided in which operator interface and control means (e.g., various controls wheels, levers, switches, buttons, screens, keyboards, etc.), are stationed. One of the controls available to the operator is a loader system 32 with a control device 34 for receiving inputs from the operator.

In an example, the loader system 32 generally includes a hydraulically operated system that effects operation of the loader 22, including for lifting and tilting/dumping. The loader 22 includes a main frame 37 to which an accessory such as a bucket 36 is attached. In other examples, the main frame 37 may be fitted with other attachments such as bale handling spikes, claws, forks, lift arms, and others. The loader 22 is removeable by being unhitched from the work vehicle 20, and the main frame 37 includes a mounting bracket 35 that is attached or hitched to the work vehicle 20 through a latch system 38. The latch system 38 includes a mechanism for unlatching the loader 22 for unhitching and removal, as well as for latching upon reattachment. The loader 22 also includes a lift cylinder 40 for lifting and lowering the main frame 37 and a tilt cylinder 42 for tilting the attachment, in this example the bucket 36.

The loader system 32 includes a power source 48, which in this example is a hydraulic pump that is included as part of the work vehicle 20. The power source 48 is operated by the engine 28 and is available to provide hydraulic power whenever the engine 28 is running. To lift the main frame 37 and the attached bucket 36, the operator uses the control device 34 to extend the rod 44 of the lift cylinder 40 under fluid power from the power source 48. The rod 44 is retracted into the lift cylinder 40 to lower the main frame 37 and the attached bucket 36 under power from the power source 48 and/or under force of gravity. To tilt the bucket 36, the operator uses the control device 34 to extend rod 46 from the tilt cylinder 42 or to retract the rod 46 into tilt cylinder 42 under power from the power source 48. It will be appreciated that a pair of lift cylinders 40, and a pair of tilt cylinders 42, are included, with one of each pair on each side of the work vehicle 20. In this example, the cylinders 40, 42 are operated through pressurized hydraulic fluid and may remain in a pressurized state following lift and tilt operations.

Figure 2:
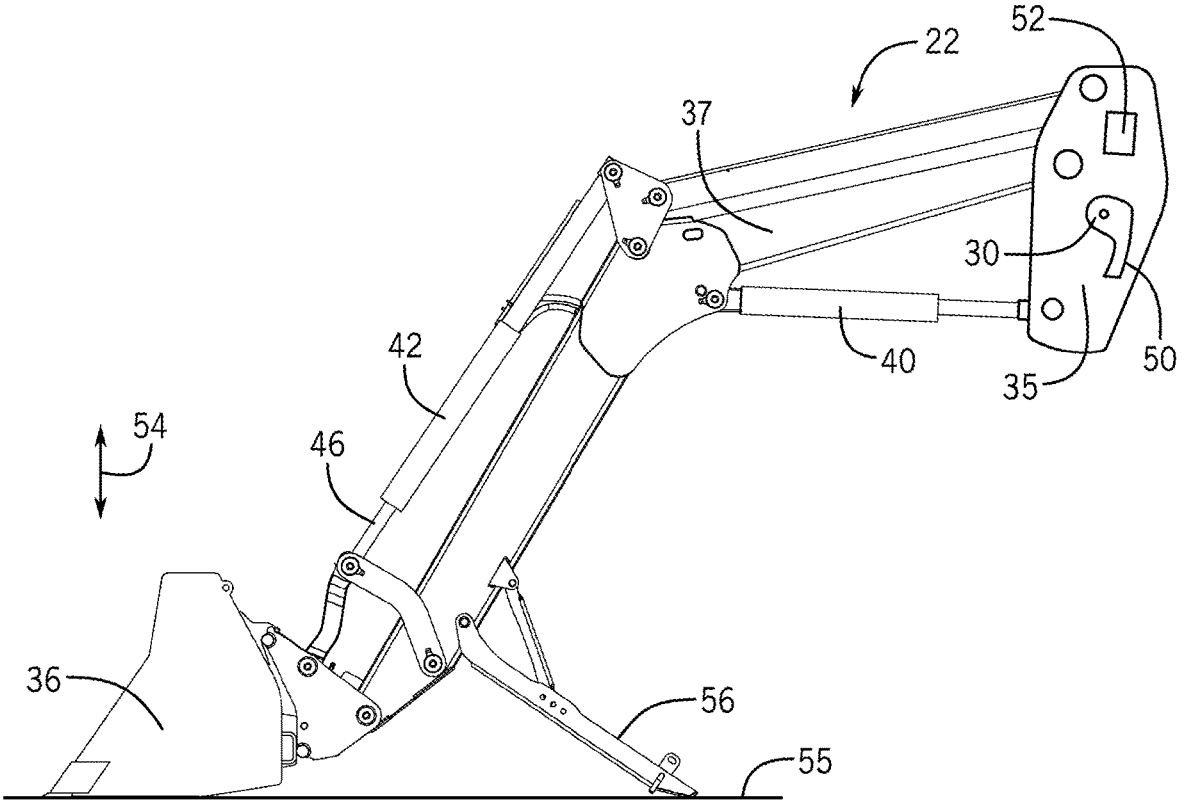
FIG. 2 is a side view of the front loader disconnected from the work vehicle.

To remove the loader 22 from the work vehicle 20, the latch system 38 includes a lever 50 which is rotated to effect unlatching. A similar lever may be included on the opposite side of the work vehicle 20, or the lever 50 may unlatch both sides. The loader system 32 includes a multi-coupler 52 to which power lines including those between the power source 48 and the cylinders 40, 42 are connected. The multi-coupler 52 provides a mechanism for coupling and uncoupling the power lines as further described below. To unhitch and remove the loader 22 from the work vehicle 20, the lever 50 is moved to an unlatch position shown in FIG. 2 and the multi-coupler 52 is uncoupled. The multi-coupler 52 is readily uncoupled when the when the cylinders 40, 42 remain pressurized as further described below. The work vehicle 20 may then be driven in reverse to separate from the loader 22. During separation, the area of the mounting bracket 35 may move in a vertical direction 54 as indicated in FIG. 2 to effect disconnection. The unattached loader 22 is parked with the bucket 36 supported on the parking surface 55 and a parking stand 56 deployed to hold the mounting bracket 35 at or near the height of the mating features on the work vehicle 20.

Figure 3:
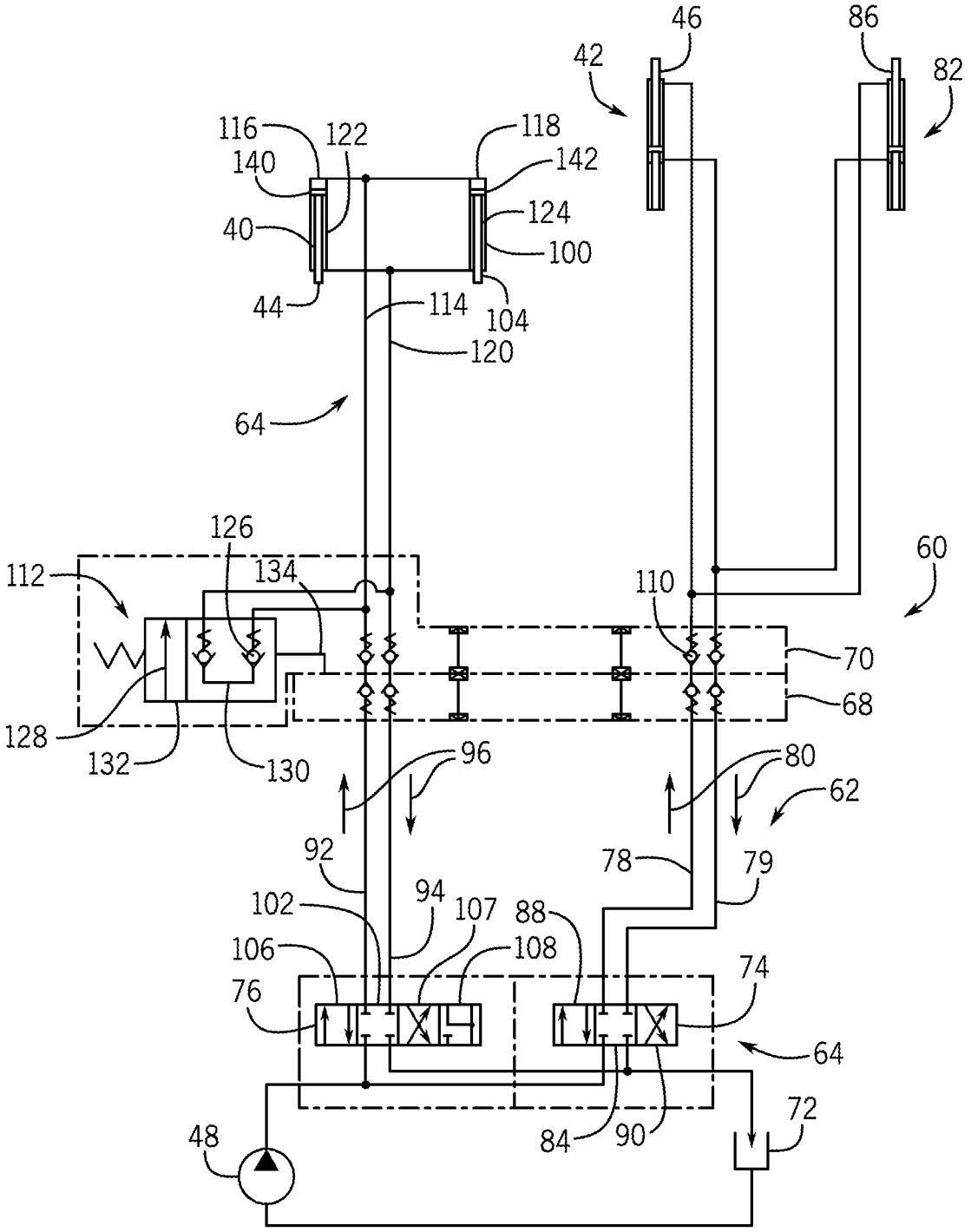
FIG. 3 is a hydraulic schematic of the front loader with a multi-coupler according to one embodiment of the disclosed system.

Referring to FIG. 3, illustrated is an example hydraulic circuit 60 for the loader system 32, which includes a work vehicle based portion 62 and a loader based portion 64. The portions 62, 64 are coupled together by the multi-coupler 52, which includes a coupling element 68 connected with the work vehicle based portion 62 and a mating coupling element 70 connected with the loader based portion 64. The work vehicle based portion 62 includes the power source 48, which draws fluid from a reservoir 72. The power source 48 delivers fluid under pressure through a pair of control valves 74, 76 responsive to the control device 34. The control valve 74 is connected with power lines 78, 79 that define a fluid path 80 through the multi-coupler 52 to the tilt cylinder 42 and to a second tilt cylinder 82. The control valve 74 has a closed position 84, which separates the power lines 78, 79 from the power source 48 and from the reservoir 72, holding the position of the rods 46, 86. The control valve 74 has a tilt position 88 that extends the rods 46, 86, and a tilt position 90 that retracts the rods 46, 86. The other control valve 76 is connected with power lines 92, 94 that help define a fluid path 96 through the multi-coupler 52 to the lift cylinder 40 and to a second lift cylinder 100. The control valve 76 has a closed position 102, which separates the loader-side conduits 114, 120 of power lines 92, 94 from the power source 48 and from the reservoir 72, holding the position of the rods 44, 104. The control valve 76 has a lift position 106 that extends the rods 44, 104, and lower positions 107, 108 that retract the rods 44, 104. In the case of lower position 107 the main frame 37 is lowered under power, and in the case of lower position 108 the main frame 37 is lowered under operation of gravitational force pushing fluid back to the reservoir 72, while the port connected to the power source 48 is closed.

The multi-coupler 52 includes eight check valves 110 that open when the coupling elements 68, 70 are mated together and that close when the coupling elements 68, 70 are decoupled from one another. The check valves 110 retain fluid in the separated portions 62, 64 of the hydraulic circuit 60, and facilitate decoupling under pressure. The coupling element 70 is connected with the loader-side conduit 114, which also connects with the barrel chambers 116, 118 of the lift cylinders 40, 100, and with a loader-side conduit 120, which connects with the rod chambers 122, 124 of the cylinders 40, 100. The multi-coupler 52 also includes a shunt valve assembly 112, which in this example is contained in the coupling element 70. The shunt valve assembly 112 includes a valve element 126 configured to alternately open or close a flow path 128 between the conduits 114, 120.

When the coupling elements 68, 70 of the multi-coupler 52 are coupled together, the valve element 126 is placed in a position 130, where the flow path 128 is closed. When the coupling elements 68, 70 of the multi-coupler 52 are uncoupled from one another, the valve element 126 is placed in a position 132 where the flow path 128 is open. A shaft 134 effects movement of the valve element 126 by contacting the coupling element 68 to close the flow path 128, or by moving away from the coupling element 68 to open the flow path 128. When the loader 22 is disconnected from the work vehicle 20, opening the flow path 128 allows the pistons 140, 142 to move within the cylinders by enabling the flow of fluid through the shunt valve assembly 112. This allows the rods 44, 104 to extend or retract when the work vehicle 20 is in the process of being disconnected from, or connected to, the loader 22 as the area of the mounting bracket 35 moves in the vertical direction 54 during unhitching/hitching. Due to equalization of the pressure between the barrel chambers 116, 118 and the rod chambers 122, 124 through the open flow path 128, the mounting bracket 35 area may readily move while the bucket 36 remains firmly planted on the parking surface 55.

Figure 4:
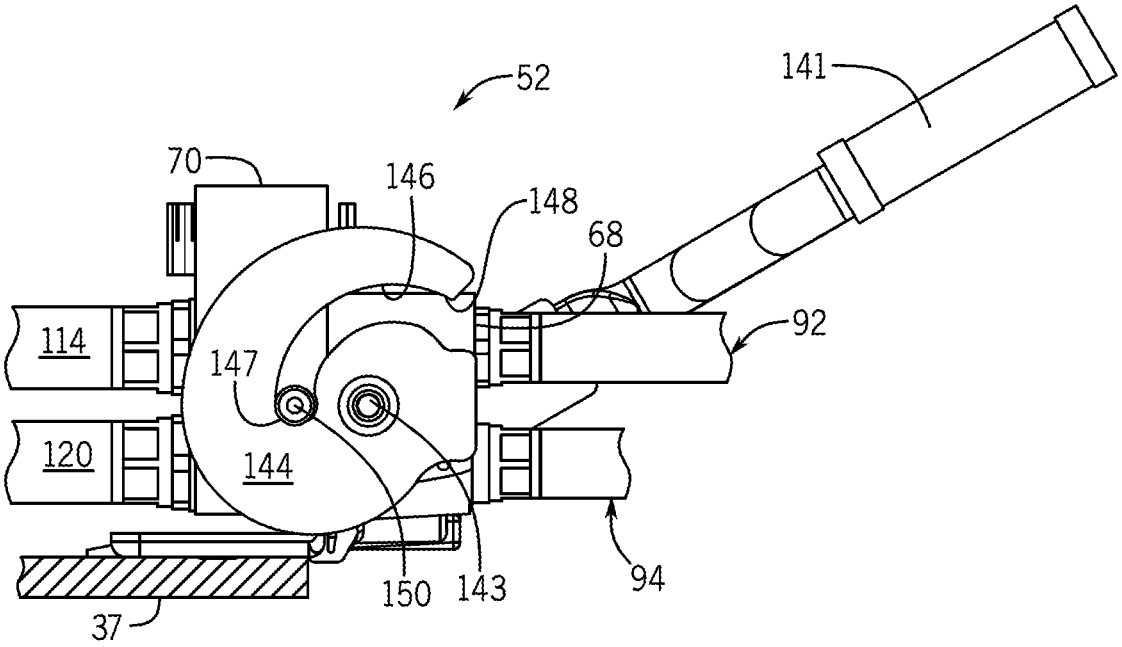
FIG. 4 is a side view of the multi-coupler of the embodiment.

Referring to FIG. 4, the multi-coupler 52 is shown mounted to the main frame 37 of the loader 22. In this example, the coupling element 70 is connected to the main frame 37 and remains therewith when the loader is parked. The coupling element 68 is shown mated and coupled with the coupling element 70 with the power lines 92, 94 passing through the multi-coupler 52. The conduits 114, 120 lead from the coupling element 70 toward the lift cylinders 40, 100. A lever 141 is connected to a pivot shaft 143 that extends through the coupling element 68 and that is also connected with a latch plate 144 so that pivoting of the lever 141 rotates the latch plate 144 about the pivot shaft 143. The latch plate 144 defines a cam slot 146 that includes a blind end 147 and an open end 148. A stud 150 extends from the coupling element 70 parallel with the pivot shaft 143 and is configured to be captured by the open end 148 of the cam slot 146 when the coupling elements 68, 70 are mated together. The cam slot 146 is closest to the pivot shaft 143 at the blind end 147 and farthest from the pivot shaft 143 at the open end 148 so that rotation (in a clockwise direction as viewed), of the lever 141 with the stud 150 captured in the cam slot 146 pulls the coupling element 70 toward the coupling element 68 to securely mate the two and to lock them together. Rotation (in a counter-clockwise direction as viewed), of the lever 141 pushes the coupling element 70 away from the coupling element 68 to unlock and decouple the two. During coupling, the check valves 110 are opened, and during decoupling the check valves 110 are closed, so that the coupling elements 68, 70 may be decoupled with pressure in the power lines 92, 94.

Figure 5:
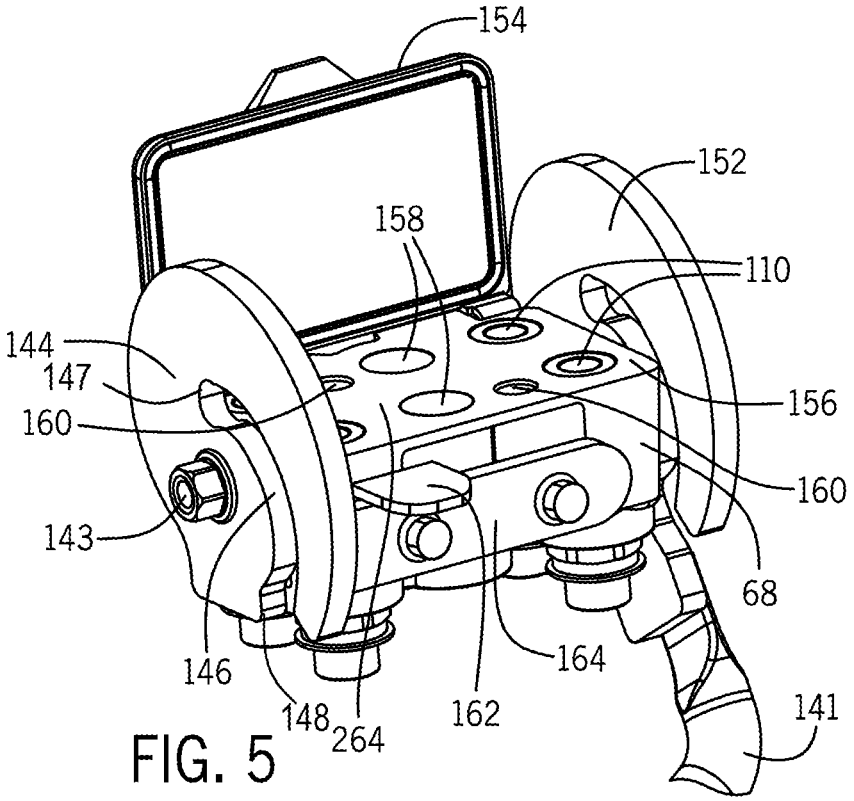
FIG. 5 is a perspective illustration of one coupling element of the embodiment.

Referring additionally to FIG. 5, the coupling element 68 is shown with the hydraulic lines omitted for simplicity. The coupling element 68 includes a second latch plate 152 on its side opposite the latch plate 144, which also rotates when the lever 141 is rotated. The check valves 110 are closed when the coupling element 68 is decoupled as shown. A cover 154 is provided to close and cover the mating surface 156 of the coupling element 68 when decoupled from the coupling element 70. The cover 154 is shown held open ready for mating with the coupling element 70, and is normally self-closing. The coupling element 68 includes ports 158 for additional power lines such as electrical connectors (shown in FIG. 6). Guide holes 160 are also included in the coupling element 68 for use in guiding the coupling element 70 to mate with the coupling element 68. A valve contact 162 in the form of a tab on a bracket 164 is provided on the coupling element 68 and is disposed parallel to the mating surface 156.

Figure 6:
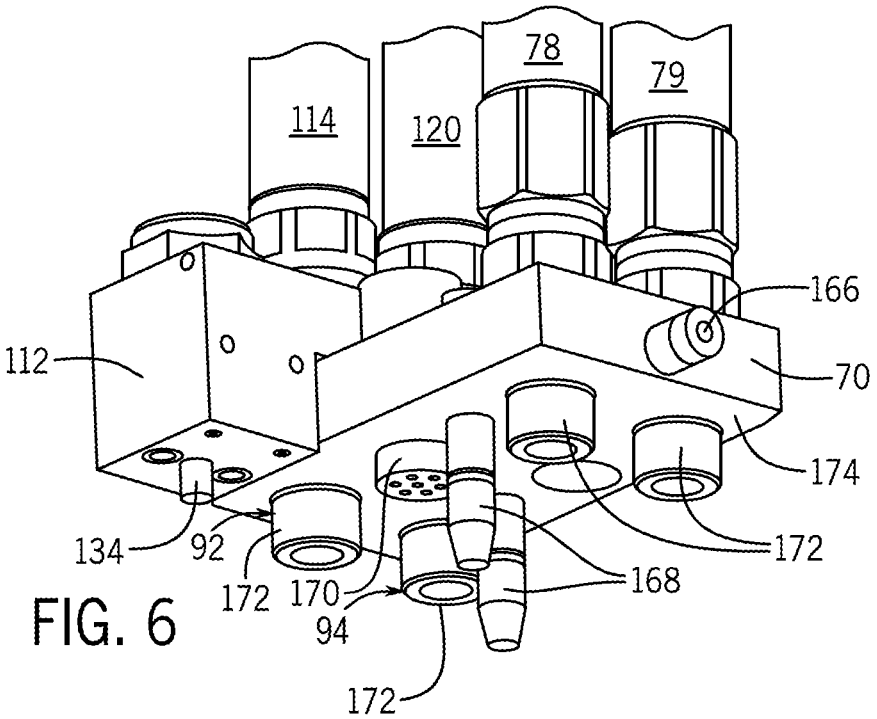
FIG. 6 is a perspective illustration of another coupling element of the embodiment.

As shown in FIG. 6, the coupling element 70 includes a second stud 166 for mating with the second latch plate 152. Guide pins 168 are provided for mating with the guide holes 160. An electrical connector 170 is provided for registering with one of the ports 158. The positions of the power lines 78, 79, 92, 94 include extensions 172 that extend from the mating surface 174 for operating the check valves 110 when the coupling elements 68, 70 are mated together. The shunt valve assembly 112 includes the shaft 134 that extends perpendicular to the mating surface 174 and that is configured to contact the valve contact 162 when the coupling elements 68, 70 are mated together.

Figure 8:
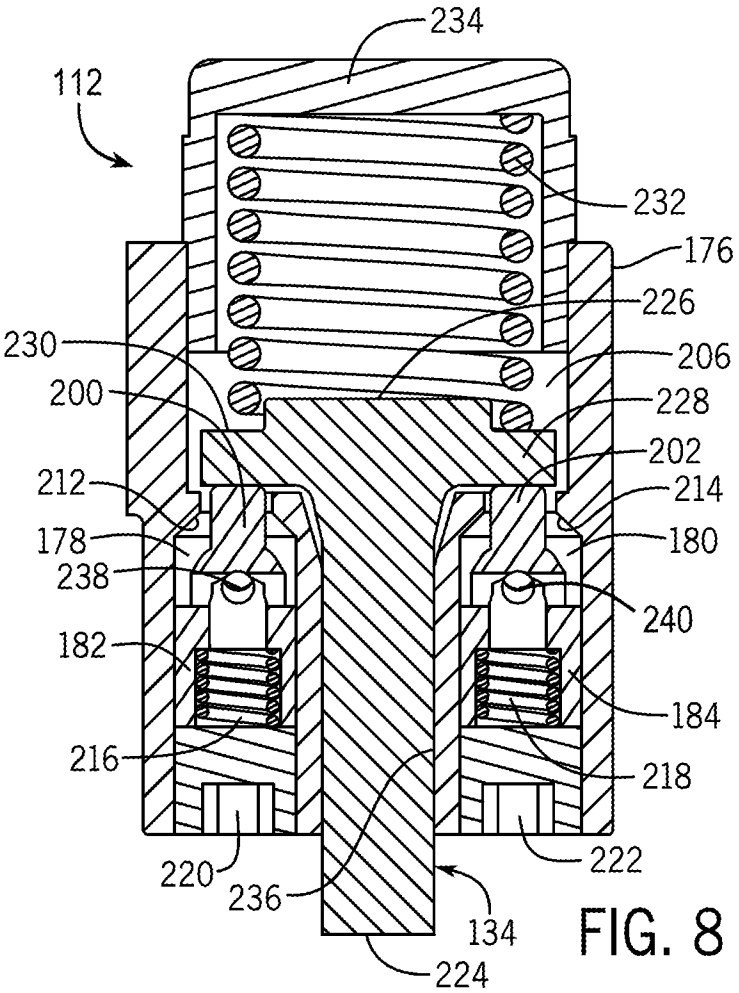
FIG. 8 is a partial, cross sectional illustration of the shunt valve area of the embodiment, in an open state.
Figure 7:
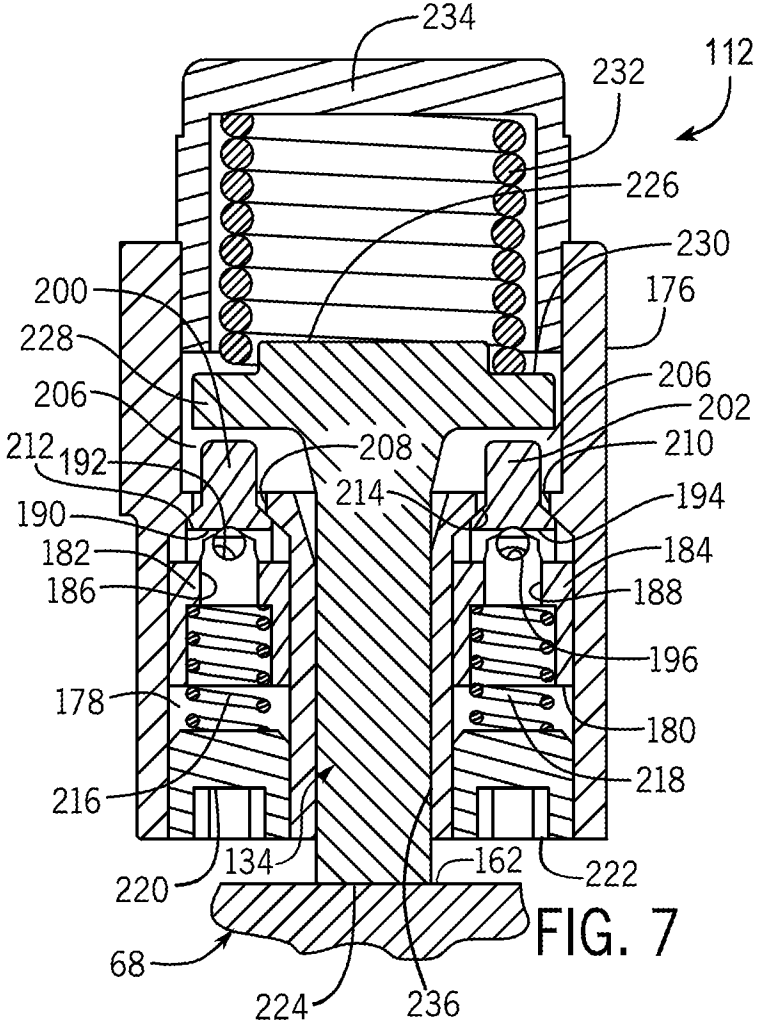
FIG. 7 is a partial, cross sectional illustration of the shunt valve area of the embodiment, in a closed state.

Referring to FIGS. 7 and 8, the shunt valve assembly 112 includes a housing 176 with bores defining valve chambers 178, 180, which contain respective valve elements 182, 184. The valve elements 182, 184 include respective internal longitudinal bores 186, 188, which extend partially through, and include transverse bores 190, 192 and 194, 196, respectively, which extend completely through. The transverse bores 190, 192 and 194, 196 intersect the longitudinal bores 186, 188, respectively. The valve elements 182, 184 include pin sections 200, 202 that extend in a direction away from the longitudinal bores 186, 188 and that are narrowed in comparison to the rest of the valve elements 182, 184. The housing 176 defines an internal chamber 206 that is spaced apart from the valve chambers 178, 180 and separated by a wall of the housing 176. Openings 208, 210 are formed in the wall between the internal chamber 206 and the valve chambers 178, 180, respectively. Valve seats 212, 214 are formed by the housing 176 around the openings 208, 210 on their sides in the valve chambers 178, 180. The valve elements 182, 184 include conical sections that seat against the valve seats 212, 214, sealing the openings 208, 210 when the flow path 128 is closed. Close springs 216, 218 are disposed in the longitudinal bores 186, 188 respectively, and are retained in position by plugs 220, 222. The close springs 216, 218 operate to seat the valve elements 182, 184 when the coupling element 70 is mated with the coupling element 68.

The shaft 134 includes a button end 224 for contacting the valve contact 162 and includes an opposite end 226 with an enlarged section 228 that is disc shaped and that is contained in the internal chamber 206. The enlarged section 228 includes a spring seat 230 that is engaged by an open spring 232 that is compressed between the spring seat 230 and a cap 234 that closes the internal chamber 206. When the coupling elements 68, 70 are either in the process of being coupled together or separated, the shaft 134 is configured to translate through a bore 236 with the enlarged section 228 translating through the internal chamber 206. The enlarged section 228 extends over the pin sections 200, 202. With the coupling elements 68, 70 coupled together as in FIG. 7, the shunt valve assembly 112 is closed with the valve contact 162 pushing the button end 224 of the shaft 134 to move the enlarged section 228 upward (as viewed) within the internal chamber 206 compressing the open spring 232. This allows the close springs 216, 218 to move the valve elements 182, 184 to seat against the valve seats 212, 214. The conduit 114 opens the barrel chambers 116, 118 of the cylinders 40, 100 to the valve chamber 178 through a port 238 on the valve element 182 side of the opening 208 so that pressure during operation assists in seating the valve element 182 minimizes any chance of leakage past the valve seat 212. The conduit 120 opens the rod chambers 122, 124 of the cylinders 40, 100 to the valve chamber 180 through a port 240 on the valve element 184 side of the opening 210 so that during operation any pressure assists in seating the valve element 184, also minimizing any chance of leakage past the valve seat 214. As a result, when the coupling elements 68, 70 are coupled together, the pressure acting on the sides of the pistons 140, 142 during operation is separated in the shunt valve assembly 112, with control provided by the control valve 76. The shaft 134 and the close springs 216, 218 are configured to effect movement of the valve elements 182, 184 to close the flow path 128 when the shaft 134 engages the valve contact 162 as the coupling elements 68, 70 are mated together.

When the coupling element 68 is decoupled from the coupling element 70 as shown in FIG. 8, moving the valve contact 162 away from the button end 224 of the shaft 134, the open spring 232 overcomes the force of the close springs 216, 218 pushing on the pin sections 200, 202 to move the valve elements 182, 184. This opens the flow path 128 between the conduits 114, 120 through the valve chamber 178, the opening 208, the internal chamber 206, the opening 210 and the valve chamber 180. As a result, the pressure acting on the sides of the pistons 140, 142 is equalized and they are allowed to float in the cylinders 40, 100 when the main frame 37 is subjected to loads during hitching and unhitching of the loader 22. The shaft 134 and the open spring 232 are configured to effect movement of the valve elements 182, 184 to open the flow path 128 when the shaft 134 disengages from the valve contact 162 as the coupling elements 68, 70 are disconnected from one another.

Figure 9:
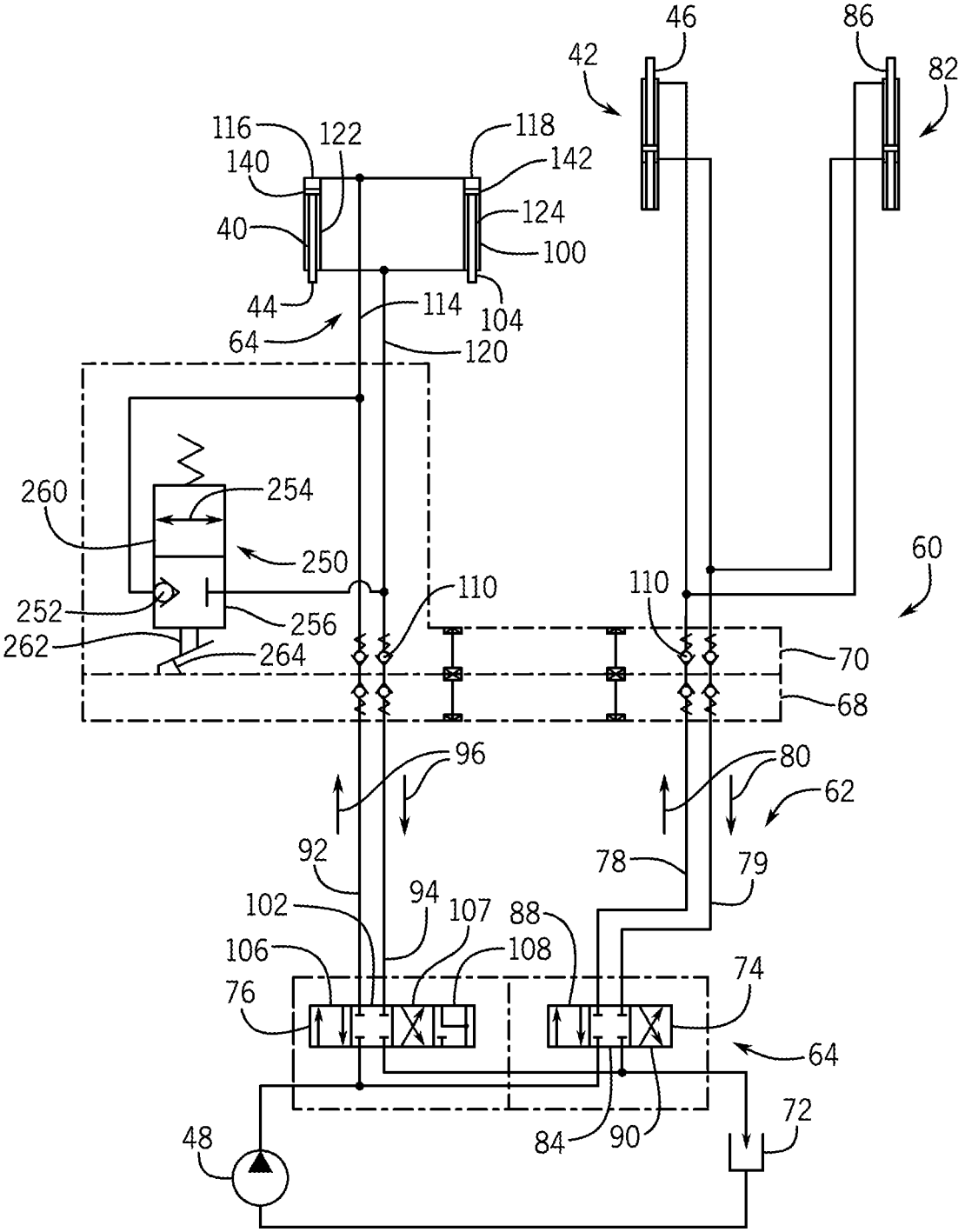
FIG. 9 is a hydraulic schematic of the front loader with a multi-coupler according to another embodiment of the disclosed system.

Referring to FIG. 9, another example involves the hydraulic circuit 60 with a shunt valve assembly 250, which is integrated into the coupling element 70. The shunt valve assembly 250 includes a valve element 252 configured to alternately open or close a flow path 254 between the conduits 114, 120. When the coupling elements 68, 70 of the multi-coupler 52 are coupled together, the valve element 252 is placed in a position 256, where the flow path 254 is closed. When the coupling element 68 is uncoupled from the coupling element 70, the valve element 252 is placed in a position 260 where the flow path 254 is open. A shaft 262 effects movement of the valve element 252 when contacted by the coupling element 68 to close the flow path 254, and when released from the coupling element 68 to open the flow path 254. When the loader 22 is disconnected from the work vehicle 20, opening the flow path 254 allows the pistons 140, 142 to move within the cylinders 40, 100 by allowing the flow of fluid through the shunt valve assembly 250. This allows the rods 44, 104 to extend or retract when the work vehicle 20 is disconnected from, or connected to, the loader 22 as the mounting bracket 35 area moves in the vertical direction 54 to unlatch/latch. Due to equalization of the pressure between the barrel chambers 116, 118 and the rod chambers 122, 124 through the flow path 254, the mounting bracket 35 area may readily move while the bucket 36 remains firmly planted on the parking surface 55.

Figure 10:
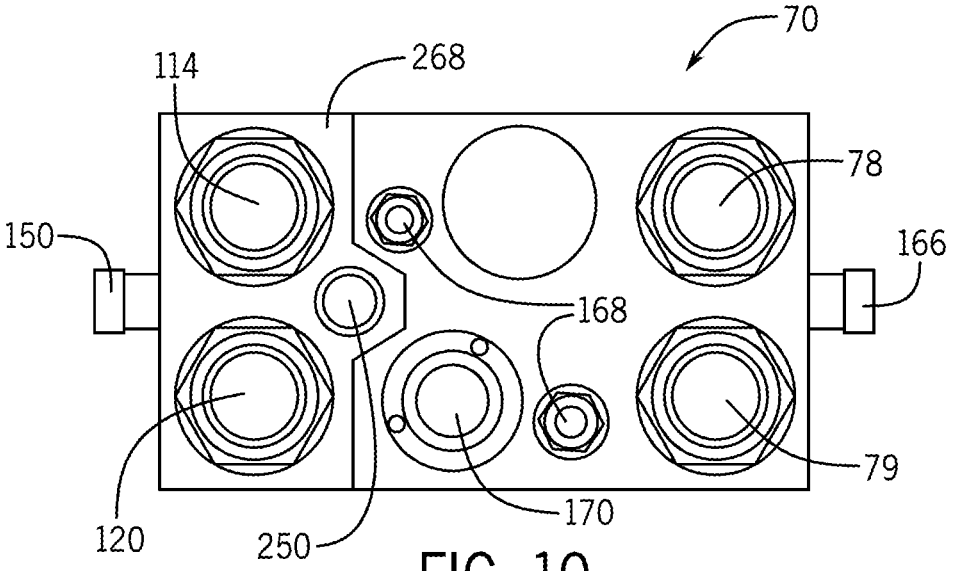
FIG. 10 is a perspective illustration of one coupling element of the other embodiment.
Figure 11:
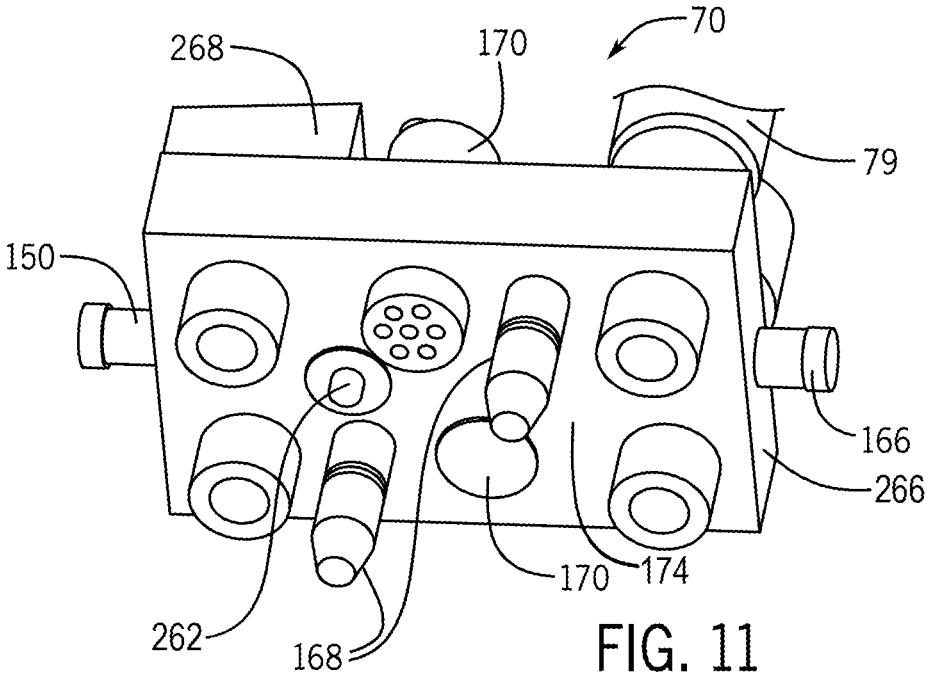
FIG. 11 is a perspective illustration of another coupling element of the other embodiment.

As shown in FIG. 10, the shunt valve assembly 250 is integrated into the coupling element 70 adjacent the connections with the conduits 114, 120 of the power lines 92, 94, respectively. The coupling element 70 includes the studs 150, 166, the electrical connector 170, the guide pins 168, and the connections with the power lines 78, 79. Referring additionally to FIG. 11, the guide pins 168 are shown extending from the mating surface 174 for mating with the guide holes 160 in the coupling element 68. The electrical connector 170 is disposed for registering with one of the ports 158. The positions of the power lines 78, 79, 92, 94 include extensions 172 that extend from the mating surface 174 for operating the check valves 110 when the coupling elements 68, 70 are mated together. The shunt valve assembly 250 includes the shaft 262, which extends perpendicular to the mating surface 174 and which is configured to contact a valve contact 264 (shown in FIGS. 5 and 9), on the mating surface 156 when the coupling elements 68, 70 are mated together. The shunt valve assembly 250 is contained in the main body 266 of the coupling element 70 and in a valve block 268. The valve block 268 is a separate attached part in this example and surrounds both the shunt valve assembly 250 and the connections with the conduits 114, 120, and provides internal connections between the three as described below.

Figure 12:
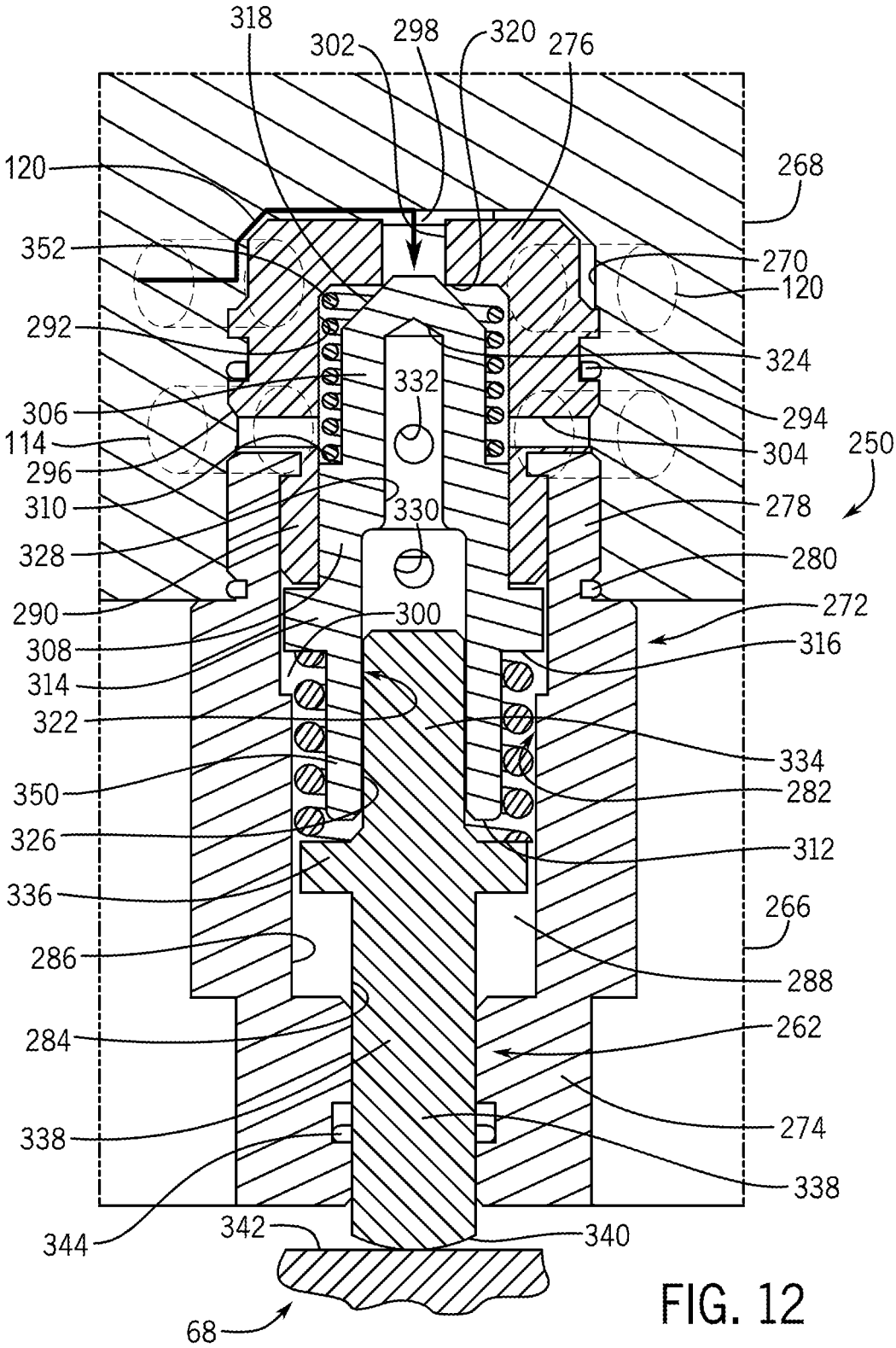
FIG. 12 is partial, cross sectional illustration of the shunt valve area of the other embodiment, in a closed state.
Figure 13:
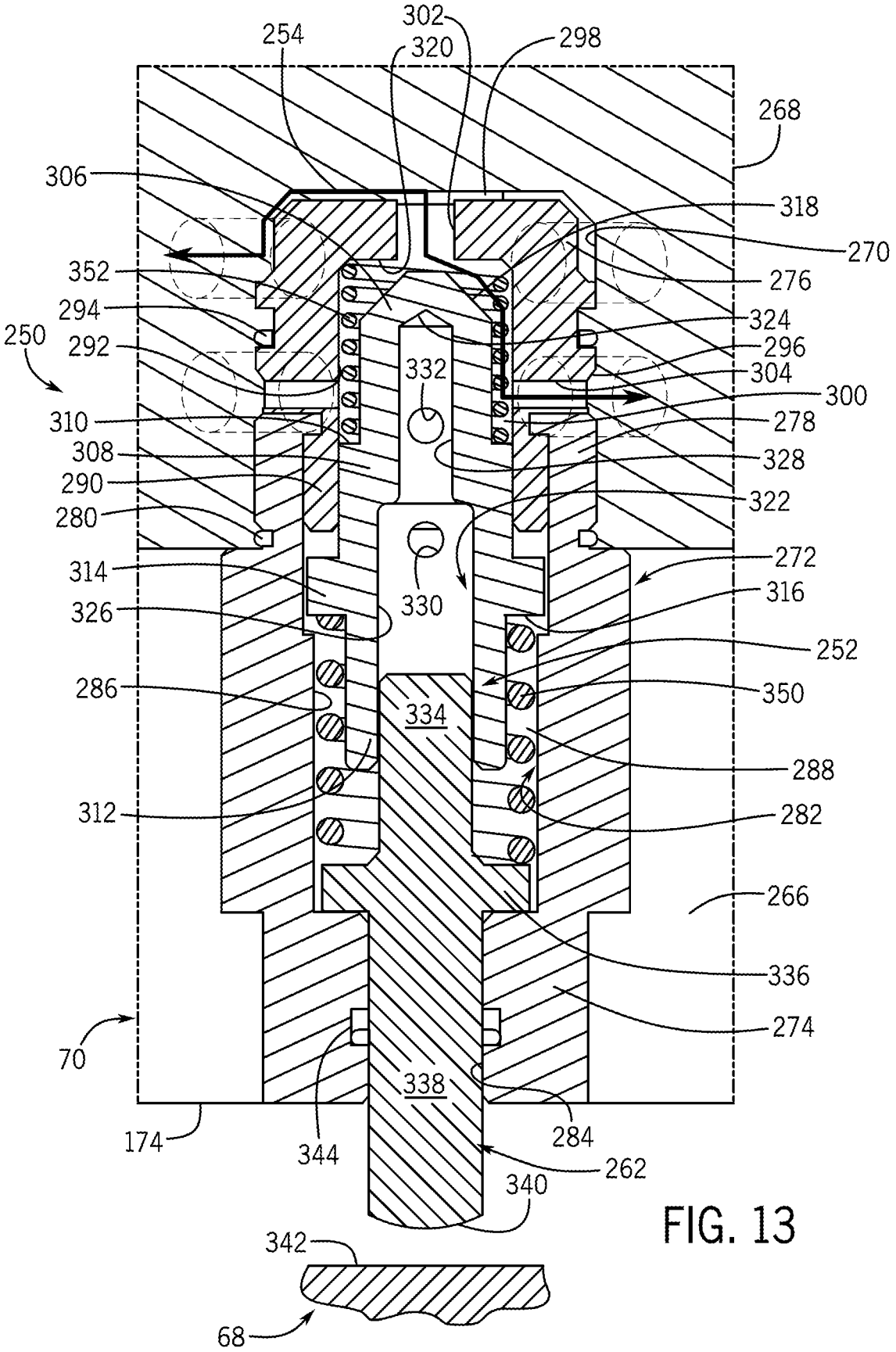
FIG. 13 is a partial, cross sectional illustration of the shunt valve area of the other embodiment, in an open state.

FIGS. 12 and 13 show the shunt valve assembly 250 in cross section and in closed and open positions, respectively. The shunt valve assembly 250 is contained in the main body 266 and in the valve block 268, which together define a bore 270. The bore 270 is open to the barrel chambers 116, 118 through the conduit 114 and to the rod chambers 122, 124 through the conduit 120. The shunt valve assembly 250 includes a valve body 272 that has a section 274 fit in the main body 266 and that includes a mating section 276. The section 274 includes a section 278 with a reduced diameter that is fit in the valve block 268. A seal 280 is disposed between the section 278 and the valve block 268. The section 274 includes a bore 282 that has a bore segment 284 and an enlarged bore segment 286 defining an internal chamber 288. The section 276 is disposed within the valve block 268 and includes a section 290 that has a reduced diameter and that is fit within the bore 282. The section 290 includes a bore 292 that is open to the bore 282. A seal 294 is disposed between the section 276 and the valve block 268. The seal 294 separates an area in the bore 270 located between the section 276 and the valve block 268 into a chamber 296 that is open to the barrel chambers 116, 118 through the conduit 114 and into a chamber 298 that is open to the rod chambers 122, 124 through the conduit 120.

Together, the bores 282, 292 define a valve chamber 300. The section 276 includes a longitudinal bore 302 that opens the valve chamber 300 to the chamber 298 and therethrough, to the conduit 120 and the rod chambers 122, 124. The section 276 includes a transverse bore 304 that opens the valve chamber 300 to the chamber 296 and therethrough, to the conduit 114 and the barrel chambers 116, 118. The transverse bore 304 extends completely through the section 276 opening laterally out both of its sides. The valve chamber 300 contains the valve element 252 that opens and closes the flow path 254. The valve element 252 has a section 306 that joins with a section 308 at a shoulder 310 forming a spring seat that faces toward the longitudinal bore 302. The section 308 has a diameter that is larger than that of the section 306. The section 308 extends to the end 312 of the valve element 252 and includes a segment 314 that has a diameter larger than that of the remainder of the section 308. The segment 314 is disposed in the internal chamber 288 and forms a spring seat 316 facing away from the longitudinal bore 302. The valve element 252 includes an end 318 opposite the end 312 that is conical in shaped with a flat terminal end, and that is shaped to mate with a valve seat 320 that surrounds the longitudinal bore 302 on its side in the valve chamber 300.

The valve element 252 has a longitudinal bore 322 extending in through its end 312 to a blind end 324 near the end 318. The longitudinal bore 322 extends completely through the section 308 and partly through the section 306 and includes a larger diameter segment 326 and a smaller diameter segment 328. A transverse bore 330 extends through the valve element 252 at the larger diameter segment 326 intersecting and opening the longitudinal bore 322 to the valve chamber 300. A transverse bore 332 extends through the valve element 252 at the smaller diameter segment 328 also intersecting and opening the longitudinal bore 322 to the valve chamber 300.

The shaft 262 includes a section 334 that extends into the bore 322, an enlarged section 336 spaced apart from the end 312, and a section 338 that extends into and through the bore segment 284. The segment 328 includes an end 340 that is extendable out of the bore segment 284 beyond the mating surface 174. The end 340 is disposed to contact the coupling element 68 at valve contact 342. The enlarged section 336 is disposed in the bore segment 286 and is larger in diameter than the bore segment 284, and therefore retains the shaft 262 in the coupling element 70. A seal 344 is disposed between the valve body 272 and the shaft 262 at the section 338.

A close spring 350 extends between the spring seat 316 and the enlarged section 336 and spirals around the section 334 of the shaft 262. The close spring 350 urges the valve element 252 toward the valve seat 320. An open spring 352 extends within the valve chamber 300 between the shoulder 310 and the section 276, and spirals around the section 306 of the valve element 252. The open spring 352 urges the valve element 252 away from the valve seat 320. The close spring 350 and the open spring 352 have spring rates such that when the coupling elements 68, 70 are decoupled and the end 340 of the shaft 262 is allowed to move outward from the bore 282, the force exerted on the valve element 252 by the open spring 352 overcomes the force exerted on the valve element 252 by the close spring 350, and the flow path 254 is opened as shown in FIG. 13. This allows fluid to move through the valve chamber 300 opening the barrel chambers 116, 118 to the rod chambers 122, 124 so that the mounting bracket 35 area of the loader 22 may move in the vertical direction 54 to unlatch/latch the loader 22 form the work vehicle 20.

When the coupling elements 68, 70 are coupled together as shown in FIG. 12, the end 340 of the shaft 262 contacts the valve contact 342 on the coupling element 68, which forces the shaft 262 into the bore 282. The section 334 of the shaft 262 slides within the bore segment 326 of the bore 322, and the enlarged section 336 moves closer to the spring seat 316, compressing the close spring 350. As a result, the compressed close spring 350 applies a force to the valve element 252 that is greater than the force applied by the open spring 352. The valve element 252 moves so that the end 318 is seated against the valve seat 320 as shown in FIG. 12, closing the flow path 254. The close spring 350 is sized with a spring rate large enough so that pressure experienced at the longitudinal bore 302 when the lift cylinders 40, 100 are operated, maintains the valve element 252 in a seated position on the valve seat 320.

Figure 14:
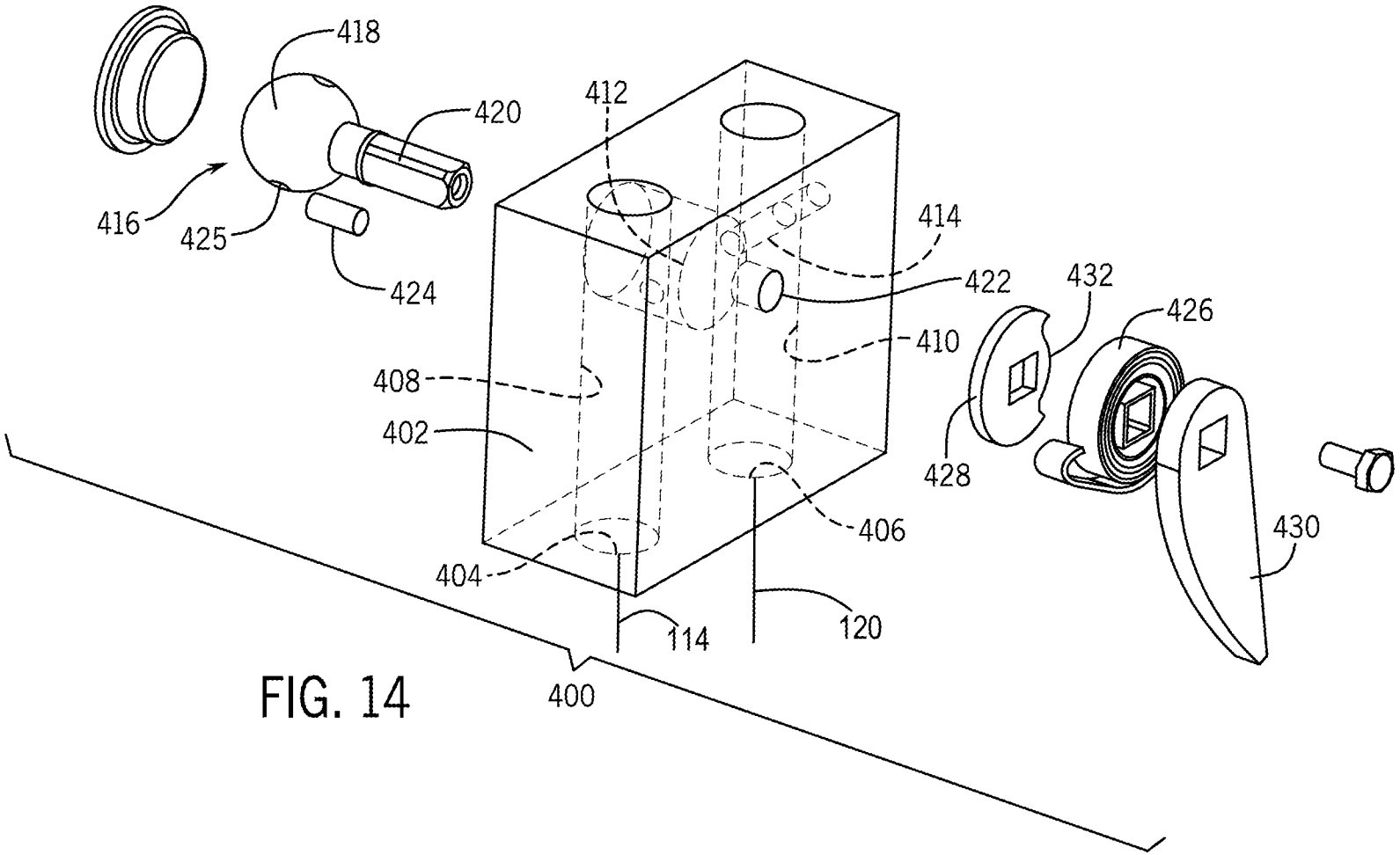
FIG. 14 is an exploded perspective view of a shunt valve assembly according to an additional embodiment of the disclosed system.
Figure 15:
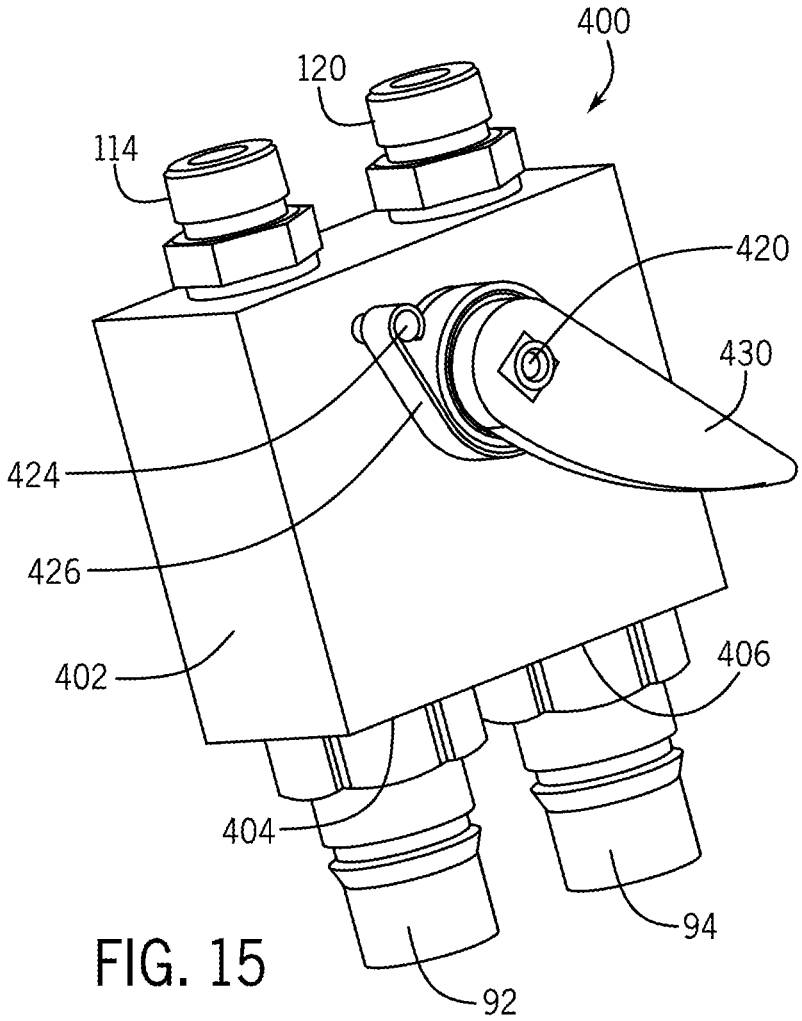
FIG. 15 is a perspective view of a shunt valve assembly of FIG. 14.

Referring to FIGS. 14 and 15, shown is another example shunt valve assembly 400. The shunt valve assembly includes a valve block 402 configured to be assembled on the coupling element 70 with a port 404 open to the conduit 114 and a port 406 open to the conduit 120. Accordingly, the valve assembly alternatively opens and closes a flow path between the conduits 114, 120 through the valve block 402. The valve block 402 includes a bore 408 open to the conduit 114 through the port 404, and a bore 410 open to the conduit 120 through the port 406. A valve chamber 412 is open to the bore 408 and through a bore 414 to the bore 410. A valve element 416 includes a ball 418 and a connected shaft 420, and is configured fit in the valve block 402 with the ball 418 residing in the valve chamber 412 and the shaft 420 extending out of the valve block 402 through a bore 422. A bore 425 extends through the ball 418 and when registered with the bore 414, opens the bore 408 to the bore 410. When the ball 418 is rotated so that the bore 425 is moved out of registry with the bore 414, the bores 408, 410 are closed off from one another. A pin 424 is engaged in the valve block 402 and serves as a connection point for one end of a spring 426. The spring 426, along with a spacer 428 and a cam lever 430 fit over the shaft 420. The spring 426 includes another end that is square to fit over the shaft 420 so that the spring 426 biases the valve element 416 to open. The spacer 428 includes a cutout 432 that delimits rotation of the cam lever 430 in both directions corresponding to open and closed positions of the shunt valve assembly 400.

Figure 16:
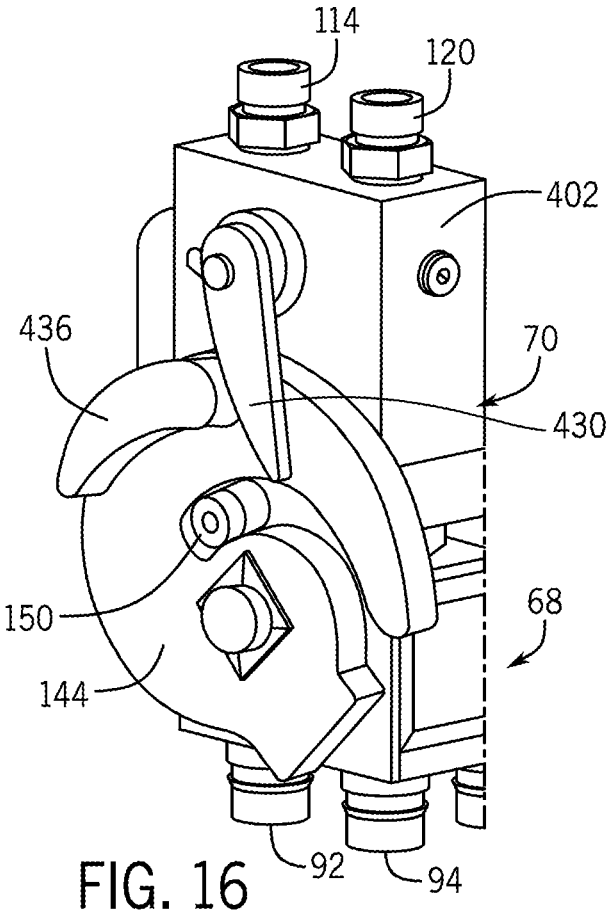
FIG. 16 is a partial perspective illustration of the multi-coupler of the additional embodiment, unlatched with the shunt valve open.
Figure 17:
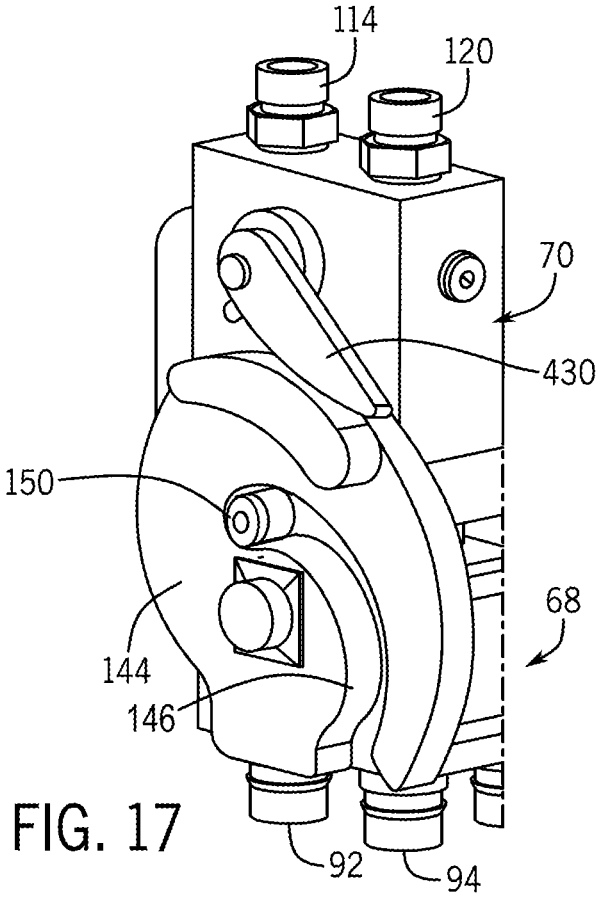
FIG. 17 is a partial perspective illustration of the multi-coupler of the additional embodiment, latched with the shunt valve open.

Referring to FIG. 16, the shunt valve assembly 400 is shown assembled on the coupling element 70, which is engaged with the coupling element 68. When the latch plate 144 is rotated to unlatch the coupling elements 68, 70 as shown in FIG. 16, the cam lever 430 is free to rotate to an open position that is maintained when the coupling elements 68, 70 are separated. The latch plate 144 includes a cam 436. When the latch plate 144 is rotated to latch the coupling elements 68, 70 together as shown in FIG. 17, the cam 436 rotates the cam lever 430, and rotates the attached valve element 416 to a closed position. In the closed position, the ball 418 of the valve element 416 is positioned so that the bore 425 is out of alignment with the bore 414 and the flow path is closed off between the conduits 114, 120. The closed position corresponds to a latched position of the coupling elements 68, 70 where the stud 150 is at the blind end 147 of the cam slot 146.

Through the examples described herein, a shunt valve system enables connecting and disconnecting an implement such as a front loader under hydraulic pressure. The shunt valve is activated to create a communication flow path between the two sides of the lift cylinder pistons simultaneous with disconnection. Connection of the implement's powered element with a power source through a coupler automatically closes the flow path for operation of the powered element by the power source.

Also, the following examples are provided, which are numbered for easier reference.

1. A shunt valve system for alternatively opening and closing a passage between first and second chambers of a powered element operated by a power source, including a coupler configured to connect the powered element with the power source, the coupler including a first coupling element connected with the powered element and a second coupling element connected with the power source, the second coupling element including a valve contact, wherein the first and second coupling elements are configured to mate with one another to connect the powered element with the power source; a shunt valve assembly contained in the first coupling element, the shunt valve assembly comprising: a valve chamber; a first conduit connecting the valve chamber with the first chamber of the powered element; a second conduit connecting the valve chamber with the second chamber of the powered element; a valve element configured to alternatively open or close a flow path between the first conduit and the second conduit; and a shaft configured to move the valve element, wherein the shaft extends from the first coupling element; wherein the shaft is configured to effect movement of the valve element to close the flow path when the shaft engages the valve contact when the first and second coupling elements are mated together; and wherein the shaft is configured to effect movement of the valve element to open the flow path when the shaft disengages from the valve contact as the first and second coupling elements are disconnected from one another.

2. The system of example 1, further comprising: a close spring engaging the valve element and configured to move the valve element to close the flow path when the first and second coupling elements are mated together.

3. The system of example 2, further comprising: an open spring disposed in the first coupling element and configured to move the valve element to open the flow path when the first and second coupling elements are disconnected from one another.

4. The system of example 3, wherein the shaft includes an enlarged section that is disc shaped, and wherein the open spring engages the enlarged section.

5. The system of example 4, wherein the enlarged section is configured to engage the valve element to open the flow path when the first and second coupling elements are disconnected from one another.

6. The system of example 5, wherein the first coupling element defines an internal chamber containing the enlarged section and defines an opening connecting the valve chamber with the internal chamber; and wherein the valve element includes a pin section that extends through the opening and is configured to engage the enlarged section.

7. The system of example 6, wherein: the open spring contacts the enlarged section and the close spring contacts the valve element; the open and close springs are configured so that the open spring applies a force compressing the close spring to open the flow path solely under operation of the force; and the open and close springs are configured so that the close spring moves the valve element to close the flow path when the open spring is compressed under operation of the shaft when the first and second coupling elements are mated together.

8. The system of example 3 wherein the shaft includes an enlarged section that is disc shaped, and wherein the close spring engages the enlarged section.

9. The system of example 4, wherein the enlarged section is configured to compress the close spring to move the valve element to close the flow path when the first and second coupling elements are mated together.

10. The system of example 9, wherein: the open and close springs both contact the valve element; the open and close springs are configured so that the open spring applies a force compressing the close spring to open the flow path when the first and second coupling elements are disconnected from one another so that the shaft extends from the first coupling element allowing the close spring to expand; and the open and close springs are configured so that the close spring moves the valve element to close the flow path when the close spring is compressed under operation of the shaft when the first and second coupling elements are mated together.

11. A shunt valve system comprising: a cylinder having a piston separating the cylinder into a barrel chamber and a rod chamber, the cylinder having a rod extending from the piston through the rod chamber; a coupler configured to connect the cylinder with a power source, the coupler including a first coupling element connected with the barrel and piston chambers and a second coupling element including a valve contact, wherein the first and second coupling elements are configured to mate with one another to connect the cylinder with the power source, wherein the first and second coupling elements are configured to disconnect from one another opening a flow path between the barrel chamber and the rod chamber simultaneous with disconnecting; a shunt valve assembly contained in the first coupling element, the shunt valve assembly comprising: a valve chamber; a first conduit connecting the valve chamber with the barrel chamber; a second conduit connecting the valve chamber with the rod chamber; a valve element configured to alternatively open or close the flow path; and a shaft configured to move the valve element, wherein the shaft extends from the first coupling element; wherein the shaft is configured to effect movement of the valve element to close the flow path when the shaft engages the valve contact as the first and second coupling elements are mated together; and wherein the shaft is configured to effect movement of the valve element to open the flow path when the shaft disengages from the valve contact as the first and second coupling elements are disconnected from one another.

12. The system of example 11, further comprising a close spring engaging the valve element and configured to move the valve element to close the flow path when the first and second coupling elements are mated together.

13. The system of example 12, further comprising an open spring disposed in the first coupling element and configured to move the valve element to open the flow path when the first and second coupling elements are disconnected from one another.

14. The system of example 13, wherein the shaft includes an enlarged section that is disc shaped, and wherein the open spring engages the enlarged section.

15. The system of example 14, wherein the enlarged section is configured to move the valve element to open the flow path when the first and second coupling elements are disconnected from one another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A shunt valve system for alternatively opening and closing a passage between first and second chambers of a powered element operated by a power source, the shunt valve system comprising:

a coupler configured to connect the powered element with the power source, the coupler including a first coupling element connected with the powered element and a second coupling element connected with the power source, the second coupling element including a valve contact, wherein the first and second coupling elements are configured to mate with one another to connect the powered element with the power source;

a shunt valve assembly contained in the first coupling element, the shunt valve assembly comprising:

a valve chamber;

a first conduit connecting the valve chamber with the first chamber of the powered element;

a second conduit connecting the valve chamber with the second chamber of the powered element;

a valve element configured to alternatively open or close a flow path between the first conduit and the second conduit, the valve element comprising a first shoulder extension that forms a first spring seat;

a shaft configured to move the valve element, wherein the shaft extends from the first coupling element, the shaft comprising a second shoulder extension that forms a second spring seat, and an enlarged section that is disc shaped;

a close spring engaging the valve element and configured to move the valve element to close the flow path when the first and second coupling elements are mated together; and an open spring disposed in the first coupling element and configured to move the valve element to open the flow path when the first and second coupling elements are disconnected from one another, wherein the open spring engages the enlarged section;

wherein the shaft is configured to effect movement of the valve element to close the flow path when the shaft engages the valve contact when the first and second coupling elements are mated together;

wherein the shaft is configured to effect movement of the valve element to open the flow path when the shaft disengages from the valve contact as the first and second coupling elements are disconnected from one another.

2. The system of claim 1, wherein the enlarged section is configured to engage the valve element to open the flow path when the first and second coupling elements are disconnected from one another.

3. The system of claim 2, wherein:

the first coupling element defines an internal chamber containing the enlarged section and defines an opening connecting the valve chamber with the internal chamber; and wherein the valve element includes a pin section that extends through the opening and is configured to engage the enlarged section.

4. The system of claim 3, wherein:

the open spring contacts the enlarged section and the close spring contacts the valve element;

the open and close springs are configured so that the open spring applies a force compressing the close spring to open the flow path solely under operation of the force; and the open and close springs are configured so that the close spring moves the valve element to close the flow path when the open spring is compressed under operation of the shaft when the first and second coupling elements are mated together.

5. A shunt valve system comprising:

a cylinder having a piston separating the cylinder into a barrel chamber and a rod chamber, the cylinder having a rod extending from the piston through the rod chamber;

a coupler configured to connect the cylinder with a power source, the coupler including a first coupling element connected with the barrel and piston chambers and a second coupling element including a valve contact, wherein the first and second coupling elements are configured to mate with one another to connect the cylinder with the power source, wherein the first and second coupling elements are configured to disconnect from one another opening a flow path between the barrel chamber and the rod chamber simultaneous with disconnecting;

a shunt valve assembly contained in the first coupling element, the shunt valve assembly comprising:

a valve chamber;

a first conduit connecting the valve chamber with the barrel chamber;

a second conduit connecting the valve chamber with the rod chamber;

a valve element configured to alternatively open or close the flow path, the valve element comprising a first shoulder extension that forms a first spring seat, a longitudinal bore extending partly through the valve element and a transverse bore intersecting the longitudinal bore and extending completely through the valve element; and a shaft configured to move the valve element, wherein the shaft extends from the first coupling element, the shaft comprising a second shoulder extension that forms a second spring seat;

wherein the shaft is configured to effect movement of the valve element to close the flow path when the shaft engages the valve contact as the first and second coupling elements are mated together;

wherein the shaft is configured to effect movement of the valve element to open the flow path when the shaft disengages from the valve contact as the first and second coupling elements are disconnected from one another.

6. The system of claim 5, further comprising:

a close spring engaging the valve element and configured to move the valve element to close the flow path when the first and second coupling elements are mated together.

7. The system of claim 6, further comprising:

an open spring disposed in the first coupling element and configured to move the valve element to open the flow path when the first and second coupling elements are disconnected from one another.

8. The system of claim 7, wherein the shaft includes an enlarged section that is disc shaped, and wherein the open spring engages the enlarged section.

9. The system of claim 8, wherein the enlarged section is configured to move the valve element to open the flow path when the first and second coupling elements are disconnected from one another.

10. The system of claim 9, wherein:

at least one of the springs contacts the enlarged section and at least one of the springs contacts the valve element;

the open and close springs are configured so that the open spring applies a force compressing the close spring to open the flow path under operation of the force; and the open and close springs are configured so that the close spring moves the valve element to close the flow path when the open spring is compressed under operation of the shaft when the first and second coupling elements are mated together.

11. The system of claim 5, wherein the first coupling element defines a valve seat and the valve element is configured to contact the valve seat to close the flow path, and wherein when the flow path is closed, the barrel chamber is connected with the valve chamber on a side of the valve seat that contains the valve element.

12. The system of claim 5, wherein:

the shaft is configured to extend from the first coupling element a first distance when the first and second coupling elements are mated together;

the shaft is configured to extend from the first coupling element a second distance when the first and second coupling elements are disconnected from one another; and the second distance is greater than the first distance.

* * * * *